US006109089A

United States Patent [19]

Farney et al.

[11] Patent Number: 6,109,089

[45] Date of Patent: Aug. 29, 2000

[54] UNIVERSAL DEVICE AND METHOD FOR GRIPPING WORKPIECES OF VARIOUS CONFIGURATIONS

[75] Inventors: Michael David Farney, Derby; Gary D. Johnson, Oxford, both of Kans.

[73] Assignee: The Boeing Company, Seattle, Wash.

[21] Appl. No.: 09/415,401

[22] Filed: Oct. 8, 1999

[51] Int. Cl.[7] ..... B21D 43/02

[52] U.S. Cl. ..... 72/422; 72/298; 72/302; 72/377

[58] Field of Search ..... 72/295, 298, 299, 72/301, 302, 311, 422, 377; 269/55, 58, 104, 142, 155

[56] References Cited

U.S. PATENT DOCUMENTS 3,440,856 4/1969 Hoffman et al. .
3,545,247 12/1970 Fazzani .
3,575,031 4/1971 Gray .
4,591,788 5/1986 Mohri et al. .
4,706,486 11/1987 Kan .
4,726,212 2/1988 Deroche et al. .
4,972,696 11/1990 Apps et al. ..... 72/299
6,018,970 2/2000 Ford et al. ..... 72/302

*Primary Examiner*—Ed Tolan
*Attorney, Agent, or Firm*—Alston & Bird LLP

[57] ABSTRACT

A universal gripping device for gripping and holding L-shaped and T-shaped workpieces comprises a main support on which are mounted a pair of opposed gripping members and an actuator for moving one of the gripping members toward and away from the other one for gripping and releasing a workpiece. A secondary support is rotatably coupled to the main support and has second and third pairs of gripping members and associated actuators mounted thereon. The three pairs of gripping members collectively define a generally T-shaped workpiece-receiving space for receiving T-shaped and L-shaped workpieces. By rotating the secondary support relative to the main support, the angle between the gripping members can be changed for accommodating workpieces of various shapes, and the movable gripping members permit different workpiece thicknesses to be accommodated.

19 Claims, 5 Drawing Sheets

UNIVERSAL DEVICE AND METHOD FOR GRIPPING WORKPIECES OF VARIOUS CONFIGURATIONS

FIELD OF THE INVENTION

The invention relates to devices and methods for gripping workpieces. The invention relates more particularly to extrusion stretch jaws or the like for gripping T-shaped and L-shaped workpieces having a variety of configurations for a stretch forming or other operation.

BACKGROUND OF THE INVENTION

In a variety of manufacturing applications, it is necessary to grip and hold a workpiece to enable an operation to be performed on the workpiece. For example, in a stretch forming operation, a workpiece is typically gripped at opposite ends in a pair of gripping devices and the gripping devices are moved apart so as to place the workpiece in tension. The tensioned workpiece is then bent around a forming member to form a desired shape.

One approach that has been used for gripping and holding a workpiece for stretch forming is to fabricate a set of complementary jaws for each configuration of workpiece that is to be gripped. The set of jaws matching a given workpiece shape is placed into a jaw holding device, generally known as a jaw head, so that the workpiece can be gripped between the jaws. In this type of gripping device and method, the gripper jaws must be precisely manufactured to the exact shape complementing that of the workpiece in order to enable the jaw head and gripper jaw to properly function. As a consequence, each configuration of workpiece to be gripped requires its own set of dedicated gripper jaws. If a substantial number of different workpiece configurations are to be worked on, it can become quite expensive to fabricate and maintain the required inventory of different gripper jaw sets. Another drawback to this approach is that variation in tolerances of the gripper jaws can cause unacceptable variances in fit and function of the jaws. Furthermore, removing one set of gripper jaws and installing a new set of jaws configured for a new workpiece configuration result in considerable amounts of wasted time.

Another approach that is used for gripping workpieces is to install in the jaw head a gripper jaw that has a shape roughly complementary to that of the workpiece. The workpiece is then modified in shape in the area to be gripped to match it to the shape of the gripper jaw. This approach, however, adds considerable time to the manufacturing process for the workpiece, and also requires undesirable modifications to the workpiece in many cases. In some instances, the requisite modifications to the workpiece to fit the gripper jaw may result in the modifications being transferred to other areas of the workpiece during manufacturing operations, which is generally undesirable.

A further drawback common to each of the above approaches is that the gripper jaws are manufactured to accommodate a particular thickness of workpiece. Accordingly, where it is desired to grip workpieces of various thickness, a number of different gripper jaws must be provided, each tailored to the thickness and shape of one particular workpiece configuration.

SUMMARY OF THE INVENTION

The present invention seeks to overcome the above-noted drawbacks and to achieve other advantages over prior gripping devices and methods. In accordance with the invention, various L-shaped and/or T-shaped workpieces can be gripped in a device having one universal set of gripping members that accommodate variations in workpiece thickness and/or shape. A preferred embodiment of the invention, as described hereinbelow, is relatively simple in construction, and the fabrication of the gripping members does not require a great amount of precision machining. Thus, the device can be made relatively inexpensively compared with prior devices requiring multiple sets of precision-machined jaws.

In accordance with a preferred embodiment of the invention, the gripping device comprises a main support and a secondary support that are rotatable relative to each other. A pair of opposed first gripping members is supported on the main support. The first gripping members define a workpiece-receiving space therebetween, and are relatively movable toward each other for gripping one portion of a workpiece and away from each other for releasing the workpiece. A first actuator, such as a hydraulic cylinder, is supported on the main support and operable to move the first gripping members relatively toward and away from each other.

The secondary support is rotatably coupled with the main support and overlies a portion of the surface of the main support. Preferably, the secondary support is a generally plate-shaped member. A pair of opposed second gripping members is supported on the secondary support so as to define a workpiece-receiving space therebetween, the second gripping members being relatively movable toward each other for gripping another portion of the workpiece. A second actuator is supported on the secondary support for moving the second gripping members relatively toward and away from each other. Relative rotational movement between the main and secondary supports permits the second gripping members to be oriented at different angles relative to the first gripping members so as to accommodate workpieces of varying shapes. For example, the workpiece-receiving space of the first gripping members can intersect the workpiece-receiving space of the second gripping members to collectively form a generally T-shaped workpiece-receiving space for receiving both T-shaped and L-shaped workpieces. The angle between the two portions making up the T-shaped workpiece-receiving space can be varied by rotating the main and secondary supports relative to each other. Thus, various workpiece configurations can readily be accommodated without changing gripping members.

Preferably, each pair of gripping members includes a stationary gripping member and a movable gripping member. The actuators are connected with the movable gripping members for gripping and releasing a workpiece. The movable gripping members advantageously are movable over a distance that is more than a minimal amount, such that workpieces of substantially varying thicknesses can be accommodated.

In a preferred embodiment of the invention, three sets of gripping members are provided. The third set is supported on the secondary support and a third actuator is provided for independently controlling movement of the third set. The two sets of gripping members on the secondary support advantageously are positioned such that their respective workpiece-receiving spaces are aligned in a straight line. Thus, the cross member of a T-shaped workpiece can be gripped in the second and third sets of gripping members on the secondary support, while the remaining leg of the workpiece is gripped in the first set of gripping members on the main support. Where an L-shaped workpiece is to be gripped, one leg of the workpiece can be gripped in either the second or third set of gripping members, while the other leg is gripped in the first set of gripping members.

The main support advantageously comprises a stationary member on which the secondary support is rotatably mounted. In a preferred embodiment of the invention, the secondary support comprises a plate-shaped member formed generally as a half circle such that one edge of the secondary support extends generally across a diameter of the half circle. The secondary support rotates about an axis that is proximate this edge. The rotation axis coincides with a point of intersection between a line aligned along the direction of the workpiece-receiving space of the first set of gripping members and a line aligned along the direction of the workpiece-receiving space of the second set of gripping members (and with the workpiece-receiving space of the third set of gripping members if a third set is present). Accordingly, rotation of the secondary support does not alter the location of this point of intersection. This enables the gripping apparatus to accommodate T-shaped and L-shaped workpieces having various angles of intersection between the legs of the workpieces.

The apparatus preferably also includes a cover at least partially enclosing the gripping members and actuators. For receiving a workpiece between the gripping members, the cover defines a window therethrough, the window being aligned with the workpiece-receiving spaces of the gripping members. The secondary support is preferably rotatable through a predetermined range of angles relative to the main support for accommodating various workpiece shapes, and the window in the cover is configured to accommodate these various workpiece shapes.

For rotatably mounting the secondary support, one of the main and secondary supports preferably defines arcuate slots formed as circular arcs about an axis, and the other of the main and secondary supports includes guide members received in these slots for guiding the secondary support to rotate about the axis. Advantageously, the slots are formed in the main support and the guide members are provided on the secondary support. The secondary support preferably can rotate through an angle of at least about 30°.

The invention thus provides a unique gripping apparatus and method for accommodating a wide variety of workpiece shapes and thicknesses with a universal set of gripping members. The expense of fabricating multiple sets of gripping jaws can thereby be avoided. Furthermore, much of the precision machining that is typically required to fabricate conventional gripping jaws can be avoided by virtue of the ability of the gripping apparatus to adapt to the configuration of the workpiece to be gripped.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
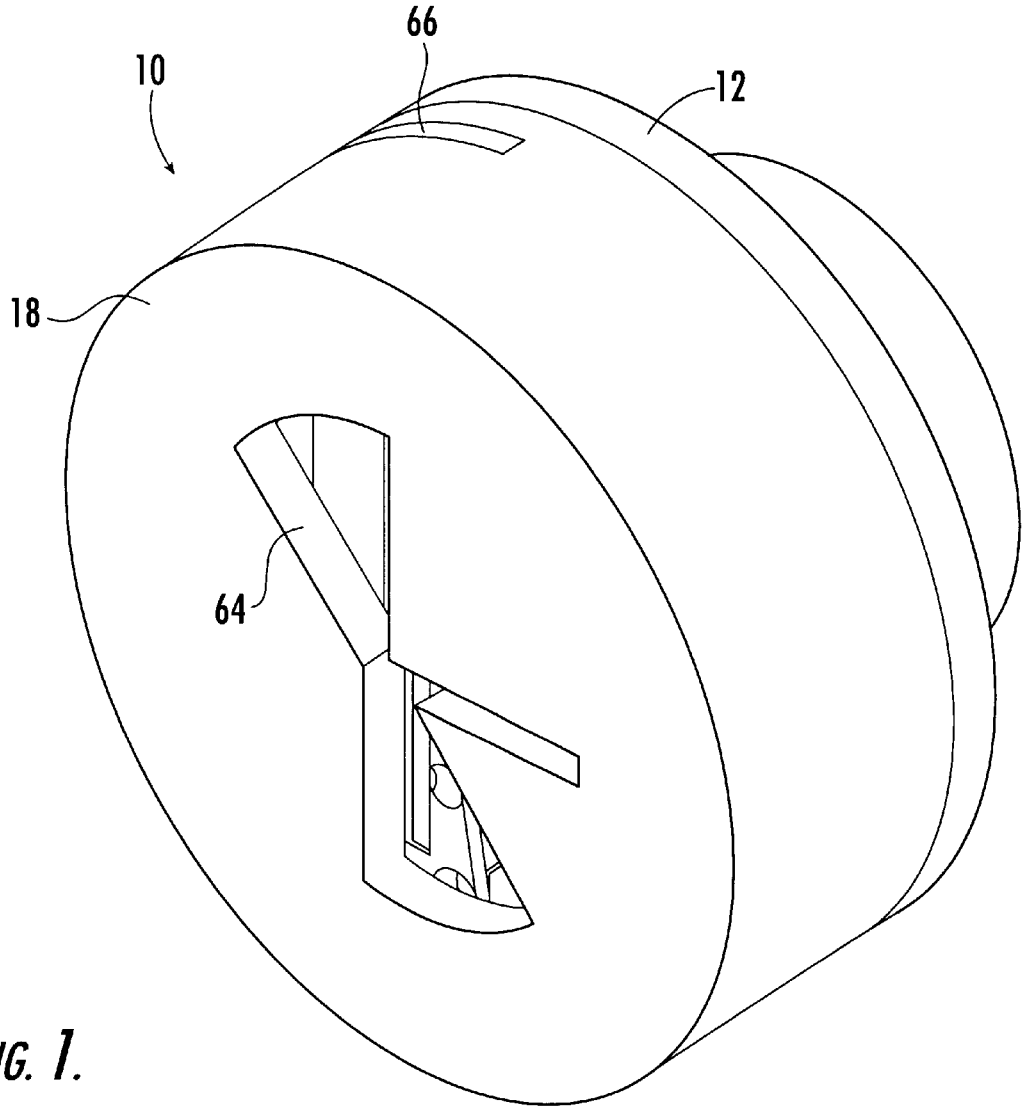
FIG. 1 is perspective view of a universal gripping apparatus in accordance with a preferred embodiment of the invention.
Figure 2:
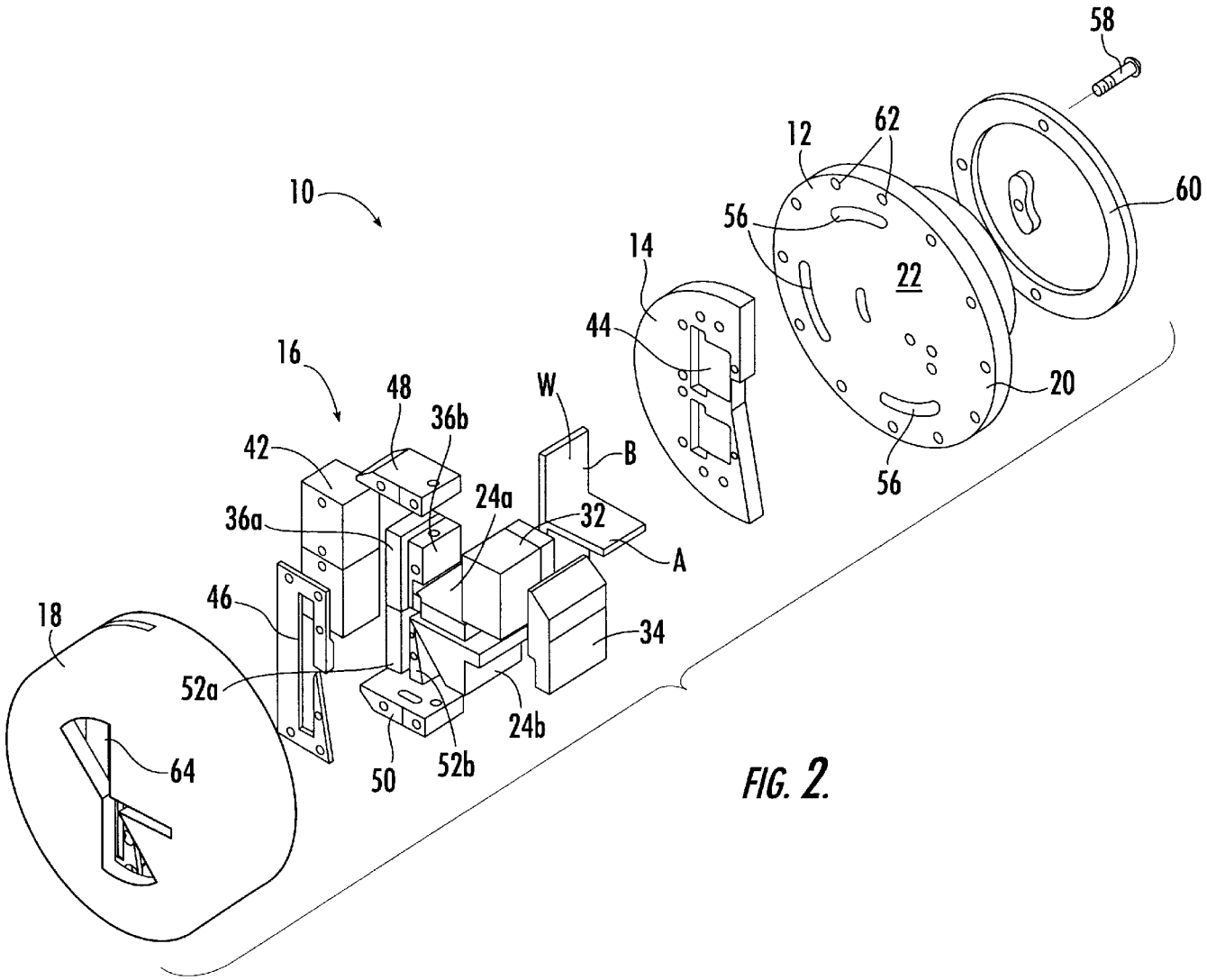
FIG. 2 is an exploded perspective view of the apparatus of FIG. 1.

With reference to FIGS. 1 through 6, a preferred embodiment of a gripping apparatus in accordance with the invention is depicted and is broadly denoted by reference numeral 10. As best seen in FIG. 2, the apparatus 10 includes a main support 12, a secondary support 14, a gripping assembly 16, and a cover 18. The main support 12 includes a generally plate-shaped portion 20 having a substantially planar surface 22.

Figure 3:
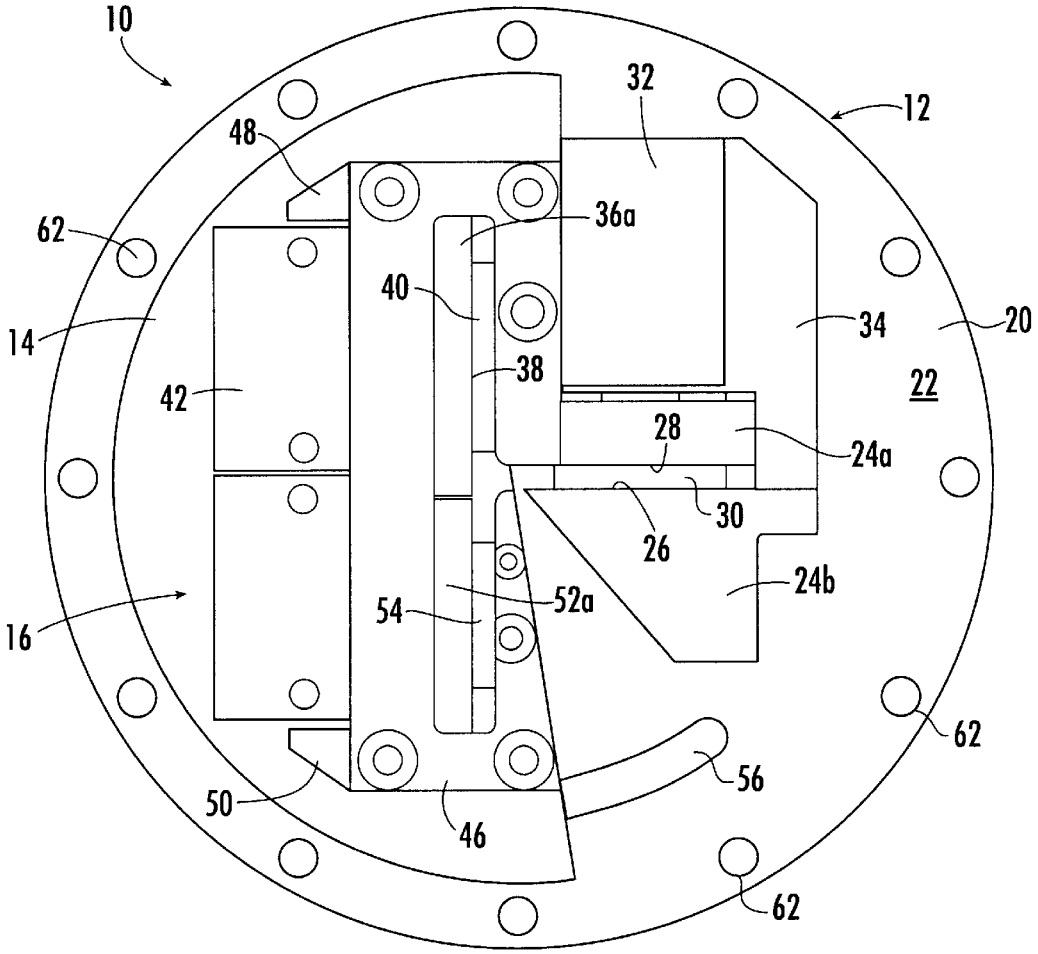
FIG. 3 is a top elevation of the apparatus of FIG. 1 with the cover removed, showing the apparatus in a position for accommodating a right-angled workpiece, and with the gripping members open.
Figure 4:
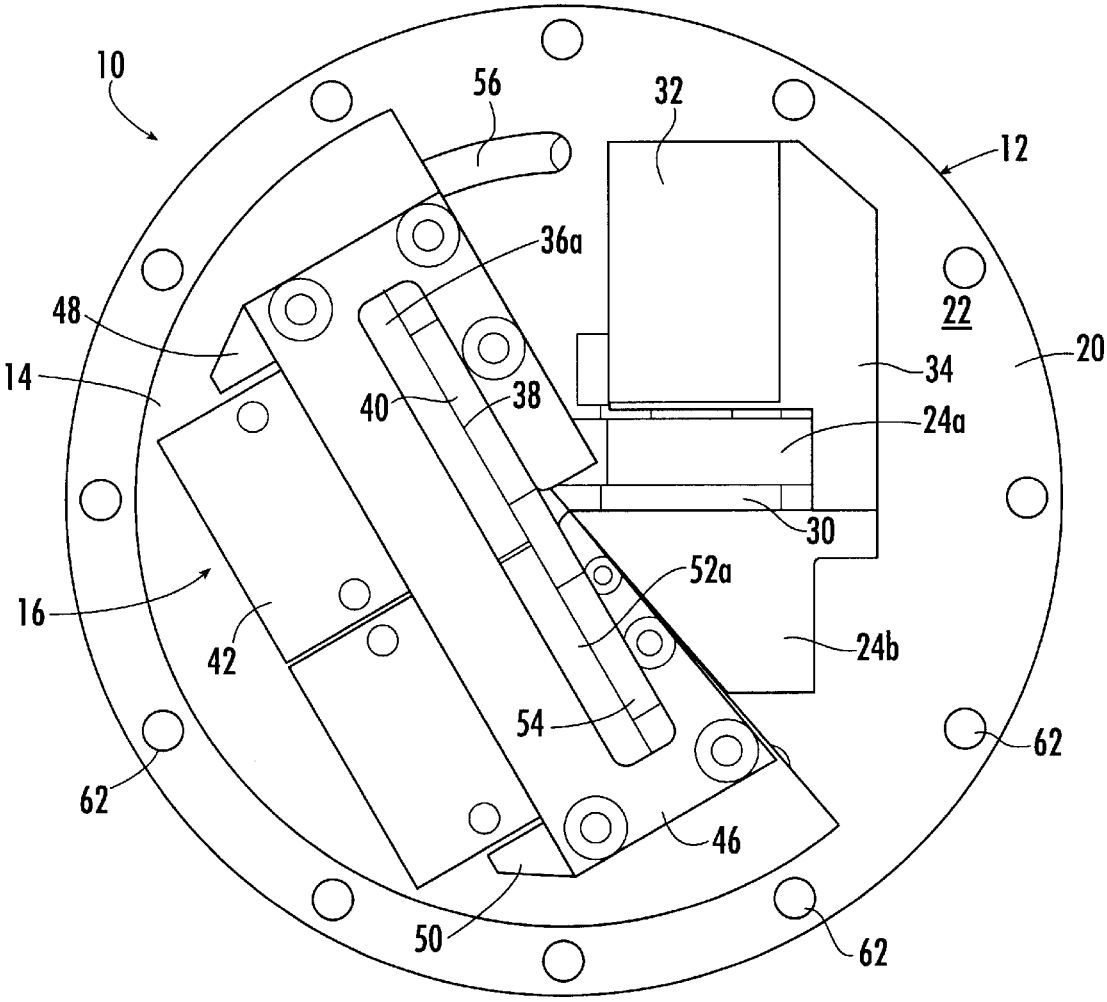
FIG. 4 is a view similar to FIG. 3, showing the apparatus in a position for accommodating a 120°-angled workpiece, and with the gripping members open.
Figure 5:
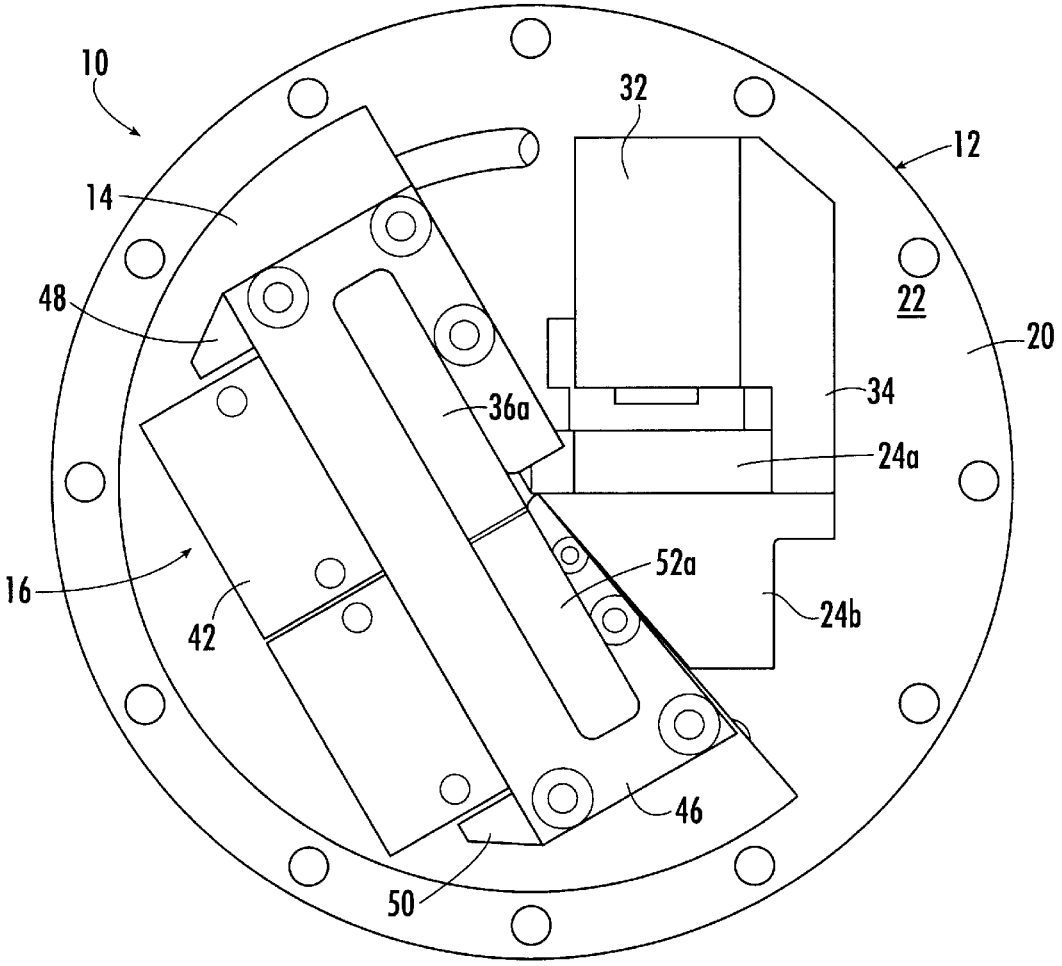
FIG. 5 is a view similar to FIG. 4, with the gripping members fully closed.

The gripping assembly 16 comprises three sets of opposed gripping members and actuators coupled with movable ones of the gripping members for selectively gripping and releasing a workpiece W. A first set of gripping members 24*a* and 24*b* is supported on the main support 12. The gripping member 24*b* is a stationary member that is fixedly mounted on the main support 12. The stationary gripping member 24*b* has a gripping surface 26 (FIG. 3) that is preferably generally planar for interfacing with a planar surface of the workpiece. The surface 26 may be knurled to improve the grip on the workpiece. The stationary gripping member 24*b* is affixed to the main support 12 in any suitable manner, such as by fasteners (not shown). The gripping member 24*a* is a movable member having a gripping surface 28 (FIG. 3) that is generally planar, and which may be knurled if desired. The movable gripping member 24*a* is movable toward and away from the stationary gripping member 24*b* such that the gripping surfaces 26 and 28 remain parallel to each other. A workpiece-receiving space 30 is defined between the stationary and movable gripping members 24*a*, 24*b*. For the T-shaped workpiece W shown in FIG. 2, the web portion A of the workpiece is received in the space between the gripping members 24*a*, 24*b*. In FIGS. 3 and 4, the movable gripping member 24*a* is shown in a position retracted away from the stationary gripping member 24*b* for receiving the workpiece, while in FIG. 5 it is shown in an extended position closing the workpiece-receiving space. The movable gripping member 24*a* is moved by an actuator 32 that is fixedly mounted on the main support 12. The actuator 32 may comprise any suitable device capable of providing the requisite degree of force to securely clamp the workpiece between the gripping members 24*a*, 24*b*. A hydraulic cylinder advantageously can be used for the purpose, but other types of devices such as electric motors with screw drives can also be used. The movable gripping member 24*a* is guided in its back and forth movement along a fixed jaw support 34 that is fixedly mounted on the main support 12 and defines a guide surface along which the movable member 24*a* slides. The jaw support 34 also provides additional support to the stationary gripping member 24*b*. The movable gripping member 24*a* is preferably movable back and forth by more than a minimal distance such that the workpiece-receiving space 30 can accommodate a range of workpiece thicknesses.

The gripping assembly 16 also includes a second set of gripping members 36*a*, 36*b* supported on the secondary support 14. The gripping member 36*b* is a stationary member fixedly mounted on the secondary support 14 such as by fasteners (not shown) or other suitable technique. The stationary gripping member 36*b* defines a planar gripping surface (not visible in the drawings) that faces the other gripping member 36*a*. The gripping member 36*a* is a movable member having a gripping surface 38 (FIG. 3) that faces the stationary gripping member 36*b*. The gripping surfaces may be knurled, if desired. The movable gripping member 36*a* is movable toward and away from the stationary gripping member 36*b* such that the gripping surfaces remain parallel to each other. A workpiece-receiving space 40 is defined between the movable and stationary gripping members 36*a*, 36*b*. For the workpiece W shown, a flange portion B of the workpiece is received within the workpiece-receiving space 40. The movable gripping member 36*a* is moved by an actuator 42 that is fixedly mounted on the secondary support 14. The actuator 42 can be a hydraulic cylinder, electric motor, or other suitable device. The movable gripping member 36*a* is guided in its back and forth movement by a slot or track 44 (FIG. 2) defined in the secondary support 14. One end of the movable gripping member 36*a* is machined to match the shape of the track 44, which can be dovetail-shaped if desired, and this end is retained within the track 44. The opposite end of the movable gripping member 36*a* is guided by a retainer plate 46 that is fixedly secured to the secondary support 14 by a pair of jaw supports 48, 50. Fasteners (not shown) may be passed through the retainer plate 46 and through the jaw supports 48, 50 into the secondary support 14 for securing the retainer plate and jaw supports to the secondary support. The jaw support 48 is adjacent the movable gripping member 36*a* and also helps guide the movable gripping member in its movement. The movable gripping member 36*a* is preferably movable back and forth by more than a minimal distance such that the workpiece-receiving space 40 can accommodate a range of workpiece thicknesses.

The gripping assembly 16 preferably also includes a third set of gripping members 52*a*, 52*b* supported on the secondary support 14 side-by-side with the second set of gripping members 36*a*, 36*b* and functioning in essentially the same manner as the second set of gripping members. The third gripping members 52*a*, 52*b* are positioned such that the workpiece-receiving space 54 defined between them is aligned in a straight line with the workpiece-receiving space 40 of the second gripping members 36*a*, 36*b*. The retainer plate 46 receives fasteners (not shown) that pass through holes formed through the stationary gripping members 36*b* and 52*b* and are received in threaded holes formed in the secondary support 14. The retainer plate 46 and its associated fasteners provide support to the second and third sets of gripping members against the pulling forces that are exerted on the workpiece W during a stretch forming operation.

The gripping apparatus 10 enables the angular relationship between the workpiece-receiving spaces 40, 54 on the secondary support 14 and the workpiece-receiving space 30 on the main support 12 to be varied for accommodating various configurations of generally L-shaped and T-shaped workpieces. To this end, the secondary support 14 is rotatably coupled to the main support 12 so that the secondary support can be rotated about an axis passing substantially through the center of the circular plate portion 22 of the main support and normal to the surface thereof. The secondary support 14 includes three threaded holes (not shown) located at equal radii from the rotation axis and spaced apart in the circumferential direction. The main support 12 includes three arcuate guide slots 56 formed through it and located to correspond to the locations of the three holes in the secondary support 14. Three bolts 58 (only one shown in FIG. 2) having threaded end portions are passed through the guide slots 56 and are threaded into the holes in the secondary support 14. A ring-shaped washer 60 also receives the three bolts 58 for providing additional support on the back side of the main support 12. The bolts 58 are slidable within the guide slots 56 for guiding the secondary support 14 to rotate about the rotation axis relative to the main support 12.

FIGS. 3 and 4 depict the gripping apparatus 10 in two different positions of the secondary support 14 relative to the main support 12. In FIG. 3, the secondary support 14 is shown in a position such that the workpiece-receiving spaces 40 and 54 form a right angle with the workpiece-receiving space 30. The three workpiece-receiving spaces 30, 40, 54 collectively form a generally T-shaped space for receiving a T-shaped workpiece W. The apparatus 10 allows the angle between the space 30 to be varied relative to the spaces 40, 54. Thus, as shown in FIG. 4, the secondary support 14 has been rotated through an angle of 30°. An L-shaped workpiece having a 60° angle cross-section can be received into the spaces 30 and 54. Alternatively, an L-shaped workpiece having a 120° angle cross-section can be received into the spaces 30 and 40. A T-shaped workpiece having the leg portion oriented at 60° relative to the cross-member portion can be received into all three spaces 30, 40, 54. Of course, the secondary support 14 can be placed at any angular position between its two extreme positions that are limited by the opposite ends of the guide slots 56. The apparatus 10 thereby enables a wide variety of workpiece shapes to be accommodated.

The apparatus 10 also includes a cover 18 formed as a dome shape for covering and enclosing the gripping assembly 16. The cover 18 attaches to the main support 12, preferably by a series of bolts (not shown) that pass through holes 62 formed through the main support adjacent its periphery and are received into the cover. The cover includes a window 64 formed through it for allowing a workpiece to be passed through the window into the workpiece-receiving spaces of the gripping members. The cover also includes a circumferential slot 66 (FIG. 1) formed through its side wall in alignment with the outer peripheral edge of the secondary support 14 for the passage of a handle (not shown) that is attached to the secondary support 14. The handle thus projects outward from the slot 66 and can be grasped and moved along the slot 66 for rotating the secondary support 14 to a desired position relative to the main support 12. The handle can be formed by a threaded bolt or the like that is received into a threaded hole formed in the peripheral edge of the secondary support 14.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for gripping a workpiece having two portions integrally joined at an angle to each other so as to define a generally L-shaped or T-shaped cross-section for the workpiece, the apparatus comprising:

a main support defining a generally planar surface;

a pair of opposed first gripping members supported on the main support and projecting above the surface thereof, the first gripping members defining a workpiece-receiving space therebetween, the first gripping members being relatively movable toward each other for gripping one of said portions of the workpiece and being relatively movable away from each other for releasing the workpiece;

a first actuator supported on the main support and operable to move the first gripping members relatively toward and away from each other;

a secondary support rotatably coupled with the main support so as to be rotatable relative to the main support, the secondary support overlying a portion of said surface of the main support and defining a generally planar surface;

a pair of opposed second gripping members supported on the secondary support and projecting above the surface thereof, the second gripping members defining a workpiece-receiving space therebetween, the second gripping members being relatively movable toward each other for gripping the other of said portions of the workpiece and being relatively movable away from each other for releasing the workpiece; and a second actuator supported on the secondary support and operable to move the second gripping members relatively toward and away from each other;

relative rotational movement between the main and secondary supports permitting the second gripping members to be oriented at different angles relative to the first gripping members so as to accommodate workpieces of varying shapes.

2. The apparatus of claim 1, wherein the two workpiece-receiving spaces are oriented relative to each other so as to collectively form a generally T-shaped workpiece-receiving space.

3. The apparatus of claim 1, wherein the actuators comprise hydraulic cylinders.

4. The apparatus of claim 1, wherein the first gripping members comprise a stationary gripping member fixed relative to the main support and a movable gripping member movable relative to the stationary gripping member, the first actuator being operable to move the movable gripping member back and forth for gripping and releasing the workpiece.

5. The apparatus of claim 1, wherein the second gripping members comprise a stationary gripping member fixed relative to the secondary support and a movable gripping member movable relative to the stationary gripping member, the second actuator being operable to move the movable gripping member back and forth for gripping and releasing the workpiece.

6. The apparatus of claim 1, further comprising a pair of opposed third gripping members supported on the secondary support and being relatively movable toward and away from each other for gripping and releasing a portion of the workpiece, and a third actuator operable for relatively moving the third gripping members toward and away from each other.

7. The apparatus of claim 6, wherein the actuators comprise hydraulic cylinders.

8. The apparatus of claim 6, wherein each pair of gripping members comprises a stationary gripping member fixed relative to the respective support and a movable gripping member movable back and forth along said respective support.

9. The apparatus of claim 8, wherein the movable gripping members are movable by a distance that enables workpieces of various thicknesses to be gripped between the pairs of gripping members.

10. The apparatus of claim 6, wherein the actuators are operable independently of one another.

11. The apparatus of claim 6, wherein the second and third gripping members define two workpiece-receiving spaces that are aligned with each other in a straight line.

12. The apparatus of claim 6, wherein the gripping members comprise knurled plate-shaped members.

13. The apparatus of claim 6, wherein the gripping members on the secondary support are partially disposed in recesses formed in the surface of the stationary support.

14. The apparatus of claim 6, wherein the secondary support comprises a plate-shaped member having an edge, and wherein the secondary support rotates relative to the main support about an axis that is substantially normal to the secondary support proximate said edge thereof.

15. The apparatus of claim 1, further comprising a cover at least partially enclosing the gripping members and actuators, the cover defining a window therethrough, the window being aligned with the workpiece-receiving spaces of the gripping members for receiving a workpiece through the window into the workpiece-receiving spaces.

16. The apparatus of claim 15, wherein the secondary support is rotatable through a predetermined range of angles relative to the main support for accommodating various workpiece shapes, and the window in the cover is configured to accommodate said various workpiece shapes.

17. The apparatus of claim 1, wherein one of the main and secondary supports defines arcuate slots formed as circular arcs about an axis, and the other of the main and secondary supports includes guide members received in said slots for guiding the secondary support to rotate about said axis.

18. The apparatus of claim 1, wherein the secondary support rotates about an axis, and the gripping members are positioned such that lines aligned along directions of the first and second workpiece-receiving spaces intersect at said axis.

19. A method for gripping a workpiece having first and second portions integrally joined at an angle to each other so as to define a generally L-shaped or T-shaped cross-section for the workpiece, the method comprising:

gripping the first portion of the workpiece between a pair of opposed first gripping members supported on a main support;

providing a secondary support adjacent the main support and rotatable relative thereto;

providing a pair of opposed second gripping members supported on the secondary support;

rotating the secondary support relative to the main support so as to align a workpiece-receiving space defined between the second gripping members with a second portion of the workpiece; and gripping the second portion of the workpiece between the second gripping members.

* * * * *